US011328626B2

(12) United States Patent
Miwata

(10) Patent No.: US 11,328,626 B2
(45) Date of Patent: May 10, 2022

(54) PHARMACEUTICAL CONTAINER LABEL AND PHARMACEUTICAL CONTAINER

(71) Applicant: IWATA LABEL CO.,LTD., Aichi (JP)

(72) Inventor: Toru Miwata, Aichi (JP)

(73) Assignee: IWATA LABEL CO., LTD.

( * ) Notice: Subject to any disclaimer, the term of this patent is extended or adjusted under 35 U.S.C. 154(b) by 0 days.

(21) Appl. No.: 17/051,525

(22) PCT Filed: Apr. 16, 2019

(86) PCT No.: PCT/JP2019/016259
§ 371 (c)(1),
(2) Date: Oct. 29, 2020

(87) PCT Pub. No.: WO2019/220840
PCT Pub. Date: Nov. 21, 2019

(65) Prior Publication Data

US 2021/0233433 A1 Jul. 29, 2021

(30) Foreign Application Priority Data

May 17, 2018 (JP) ..... JP2018-095097

(51) Int. Cl.
*G09F 3/02* (2006.01)
*B65D 23/08* (2006.01)
*A61J 1/05* (2006.01)

(52) U.S. Cl.
CPC ..... *G09F 3/02* (2013.01); *A61J 1/05* (2013.01); *B65D 23/08* (2013.01); *G09F 2003/0273* (2013.01)

(58) Field of Classification Search
None
See application file for complete search history.

(56) References Cited

U.S. PATENT DOCUMENTS

2012/0234481 A1* 9/2012 Raming ..... G09F 3/0288 156/249
2017/0247157 A1* 8/2017 Parellada Armela ..... B31D 1/0018

FOREIGN PATENT DOCUMENTS

EP 0 283 064 A1 9/1988
JP H 11-85024 A 3/1999
JP 2006-055392 A 3/2006
(Continued)

OTHER PUBLICATIONS

International Search Report issued in application No. PCT/JP2019/016259.

*Primary Examiner* — Laura C Powers
(74) *Attorney, Agent, or Firm* — McClure, Qualey & Rodack, LLP

(57) ABSTRACT

A pharmaceutical container label 1 to be stuck to an outer circumferential surface 12*r* of a pharmaceutical container 100 having translucency, includes: a lower-layer label 2, having light-blocking property, to be adhered to the outer circumferential surface 12*r* of the pharmaceutical container 100 so as to form a non-adhesion portion 2B; and an upper-layer label 3 which is peelably stuck to a surface 2*a* of the lower-layer label 2 so as to adhere to the non-adhesion portion 2B. When the upper-layer label 3 is peeled off, the non-adhesion portion 2B is integrally peeled off, a region covered with the non-adhesion portion 2B is exposed, and the exposed region serves as a window 15 which allows visual checking of the contents.

5 Claims, 16 Drawing Sheets

(56) References Cited

FOREIGN PATENT DOCUMENTS

| | | | |
|---|---|---|---|
| JP | 2011-209463 | A | 10/2011 |
| JP | 2012-201403 | A | 10/2012 |
| JP | 3203888 | U | 4/2016 |
| JP | 2016-191804 | A | 11/2016 |
| JP | 2018-030625 | A | 3/2018 |

* cited by examiner

PHARMACEUTICAL CONTAINER LABEL AND PHARMACEUTICAL CONTAINER

CROSS-REFERENCE TO RELATED APPLICATIONS

This present application is a National Stage entry of International Application No. PCT/JP2019/016259, filed Apr. 16, 2019, which claims priority to Japanese Patent Application No. 2018-095097, filed May 17, 2018. The disclosures of the prior applications are incorporated by reference in their entirety.

FIELD OF THE INVENTION

The invention relates to a pharmaceutical container label and a pharmaceutical container to which the label is stuck.

BACKGROUND OF THE INVENTION

A pharmaceutical container sometimes has a light-blocking label adhered thereto to prevent the contents thereof from being deteriorated by light. However, since such a label is made of a metal foil or a colored and semi-transparent material, the label stuck to the container makes it difficult to accurately check the state of the color or the like of the contents from the outside.

Meanwhile, Patent Document 1 discloses a technique in which a predetermined region of a label stuck to a container is cut off to form a window, through which the contents can be visually checked. However, such a label has a cut line such as a perforated line along which the window is formed, and the cut line is likely to become a light incident part.

Patent Document 1: Japanese Laid-Open Patent Publication No. 2018-30625

SUMMARY OF INVENTION

Problems to be Solved by the Invention

An object of this invention is to provide: a pharmaceutical container label, having light-blocking property, which can easily form a window that allows checking of contents in the container from the outside, without forming a light incident part such as a perforated line; and a pharmaceutical container to which the label is stuck.

Solution to the Problems

To achieve the above-described object, the pharmaceutical container label of this invention is a pharmaceutical container label to be stuck to an outer circumferential surface of a pharmaceutical container having translucency. The label includes: a lower-layer label, having light-blocking property, to be adhered to the outer circumferential surface of the pharmaceutical container so as to form a non-adhesion portion in a predetermined region; and an upper-layer label which is peelably stuck to an outer surface of the lower-layer label so as to cover at least the non-adhesion portion and to adhere to the non-adhesion portion. The upper-layer label is peelable from the lower-layer label integrally with the non-adhesion portion to which the upper-layer label adheres. When the upper-layer label is peeled off while the lower-layer label adheres to the outer circumferential surface of the pharmaceutical container, a region, of the pharmaceutical container, covered with the non-adhesion portion is exposed to the outside, and the exposed portion allows visual checking of contents.

A pharmaceutical container according to this invention has the pharmaceutical container label according to this invention being stuck thereto.

According to the invention described above, the non-adhesion portion of the lower-layer label is not adhered to the outer circumferential surface of the pharmaceutical container and is adhered to the upper-layer label. Therefore, when the upper-layer label is peeled off, the non-adhesion portion is peeled off integrally with the upper-layer label. Meanwhile, the adhesion portion of the lower-layer label remains adhered to the outer circumferential surface of the pharmaceutical container. Therefore, only peeling the upper-layer label from the pharmaceutical container causes the region covered with the non-adhesion portion of the lower-layer label to be exposed to the outside, thereby forming a window (exposed portion) that allows visual checking of the contents. If a cut line such as a perforated line is formed in the lower-layer label to smoothly separate the non-adhesion portion of the lower-layer label from the remaining portion when the non-adhesion portion of the lower-layer label is peeled off integrally with the upper-layer label, the cut line will be formed within the non-adhesion portion. According to this invention, since the upper-layer label is adhered while covering the non-adhesion portion of the lower-layer label, the cut line is assuredly covered with the upper-layer label regardless of where it is formed in the non-adhesion portion, and therefore, the cut line does not become a light incident part.

The lower-layer label according to this invention has a cut line such as a perforated line, which surrounds a region to be the exposed portion, in the vicinity of an outer periphery of the non-adhesion portion, and the upper-layer label is stuck to the outer surface of the lower-layer label so as to cover the cut line. Since the cut line such as a perforated line is formed in the lower-layer label, when the upper-layer label is peeled off, separation and removal of the non-adhesion portion from the lower-layer label smoothly progress. Meanwhile, since the cut line such as a perforated line formed in the lower-layer label is covered with the upper-layer label, light is prevented from entering through the cut line.

As for the exposed portion formed on the pharmaceutical container by the pharmaceutical container label of this invention, the exposed portion can be formed in both an outer wall part of the container which is located at the near side and an outer wall part of the container which is located at the far side when the pharmaceutical container is laterally viewed from a predetermined position. If the lower-layer label having light-blocking property is made of a metal foil, a colored and semi-transparent material, or the like, it is difficult to check the color of the contents if the window (exposed portion) is formed only in the near-side outer wall part of the container. For example, when the lower-layer label is made of a brown semi-transparent material, then if the window (exposed portion) is formed in only the near-side outer wall part of the container, the color of the contents is recognized to be brown, which is the color of the lower-layer label stuck to the far-side outer wall part of the container, making it difficult to check the state of discoloration or the like. In contrast, according to this invention, the window (exposed portion) is formed in both the near-side outer wall part of the container and the far-side outer wall part of the container. As a result, transparent windows (exposed portions) of the same color are formed in both the near-side outer wall part of the container and the far-side outer wall part of the container. Thus, when the pharmaceutical container is laterally viewed at a position in which the near-side window and the far-side window are opposed to each other in the front-back direction, change in the state of the contents in the pharmaceutical container can be checked without being affected by the color of the lower-layer label having light-blocking property although still being affected by the color of the container body. If the body of the pharmaceutical container is colorless and transparent, colorless and transparent windows (exposed portions) are formed in both the near-side outer wall part of the container and the far-side outer wall part of the container. In this case, the original color of the contents in the pharmaceutical container can be checked without being affected by the color of the lower-layer label, and therefore, occurrence of change in state such as discoloration can be easily checked.

In this invention, "having translucency" means having a total light transmittance not less than 70% (preferably, not less than 80%, and more preferably, not less than 90%). In addition, in this invention, "having light-blocking property" means a state in which entry of light having a specific wavelength is inhibited so that change in the contents in the container is suppressed to a predetermined reference level or less within a predetermined time period. The light of the specific wavelength need not be completely shut off. Therefore, in this invention, both translucency (transparency) and light-blocking property are achieved. Meanwhile, a "label" described in this invention is a printed matter that integrates a display with a container. The label is not limited to a tack label, and may be a shrink sleeve (a label in which a lowermost layer is formed of a compressed film to which no paste is applied).

DESCRIPTION OF EMBODIMENTS

Hereinafter, a first embodiment of a pharmaceutical container label and a pharmaceutical container according to this invention will be described with reference to the drawings.

Figure 1:
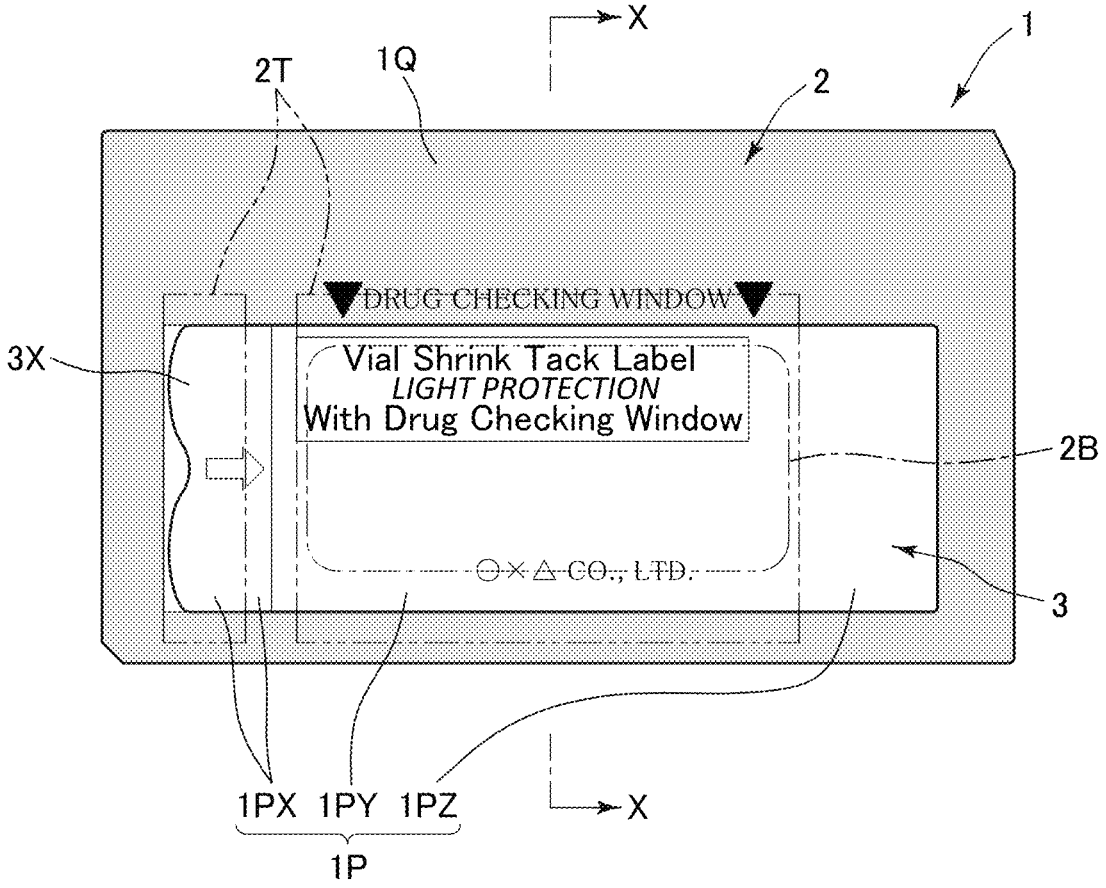
FIG. 1 is a plan view of a pharmaceutical container label according to a first embodiment of this invention.
Figure 2:
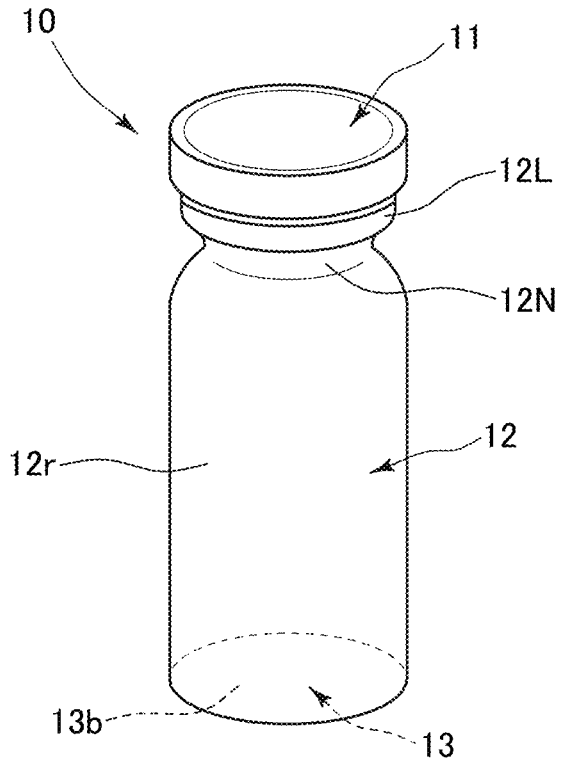
FIG. 2 is a perspective view of a body of a pharmaceutical container to which the pharmaceutical container label shown in FIG. 1 will be stuck.
Figure 3:
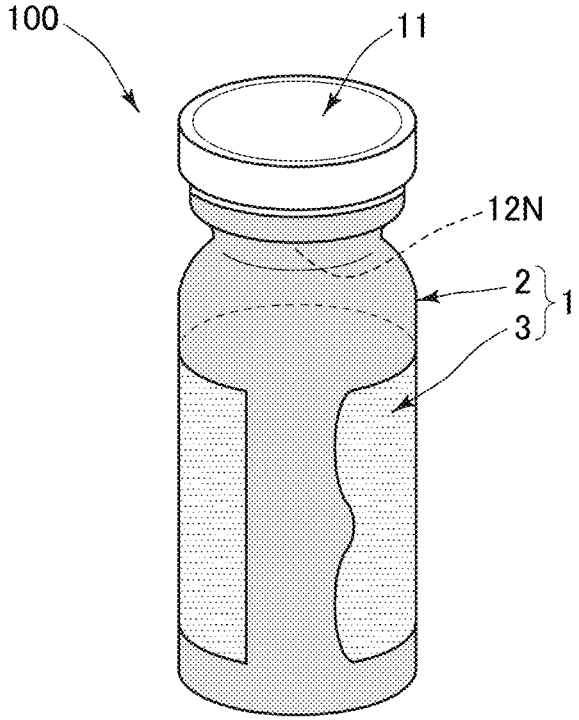
FIG. 3 is a perspective view of the pharmaceutical container to which the pharmaceutical container label shown in FIG. 1 is stuck.

FIG. 1 shows a pharmaceutical container label 1 according to this embodiment. This label 1 is stuck to a body 10 of a pharmaceutical container 100 shown in FIG. 2, resulting in a pharmaceutical container 100 as shown in FIG. 3. The container body 10 has translucency. As shown in FIG. 2, the container body 10 has a cylindrical trunk 12 having an opening at an upper end, a bottom portion 13 that is integrated with the trunk 12 and closes a lower end of the trunk 12, and an outer circumferential surface 12*r* to which the pharmaceutical container label 1 will be stuck. Although the container body 10 is a colorless and transparent vial in this embodiment, the invention is not limited thereto.

A separate lid 11 having light-blocking property is detachably fitted to an upper side of the trunk 12 of the pharmaceutical container 100 shown in FIG. 3 so as to close the opening at the upper end. As shown in FIG. 2, the trunk 12 has: a neck portion 12N having a radial-direction width narrowed upward; and a cylindrical trunk upper end portion 12L disposed above the neck portion 12N and having a radial-direction width wider than that of the neck portion 12N. The lid 11 is screwed and fitted onto the trunk upper end portion 12L. The lid 11 and the trunk 12 may be fitted to each other through another method.

Figure 4:
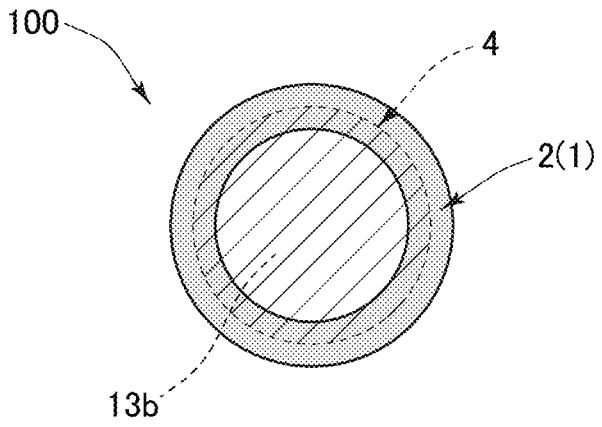
FIG. 4 is a bottom view of the pharmaceutical container shown in FIG. 3.

On the pharmaceutical container 100 shown in FIG. 3, a bottom covering member 4 having light-blocking property (light-blocking label for a bottom surface in this embodiment) is disposed on a bottom surface 13*b* of the bottom portion 13, as shown in FIG. 4. The pharmaceutical container label 1 adheres to the outer circumferential surface 12*r* of the trunk 12 of the pharmaceutical container 100, and to an outer circumference of the bottom covering member 4 in an overlapping manner. Although the bottom covering member 4 is a light-blocking label for a bottom surface in this embodiment, a member other than a label may be adopted. The pharmaceutical container label 1 may also adhere, in an overlapping manner, to an outer circumferential surface or the like of the lid 11 fitted to the trunk 12. The pharmaceutical container 100 of this embodiment forms a light blocking state that prevents light from entering toward the contents, by the pharmaceutical container label 1, the bottom covering member 4, and the lid 11.

Figure 5:
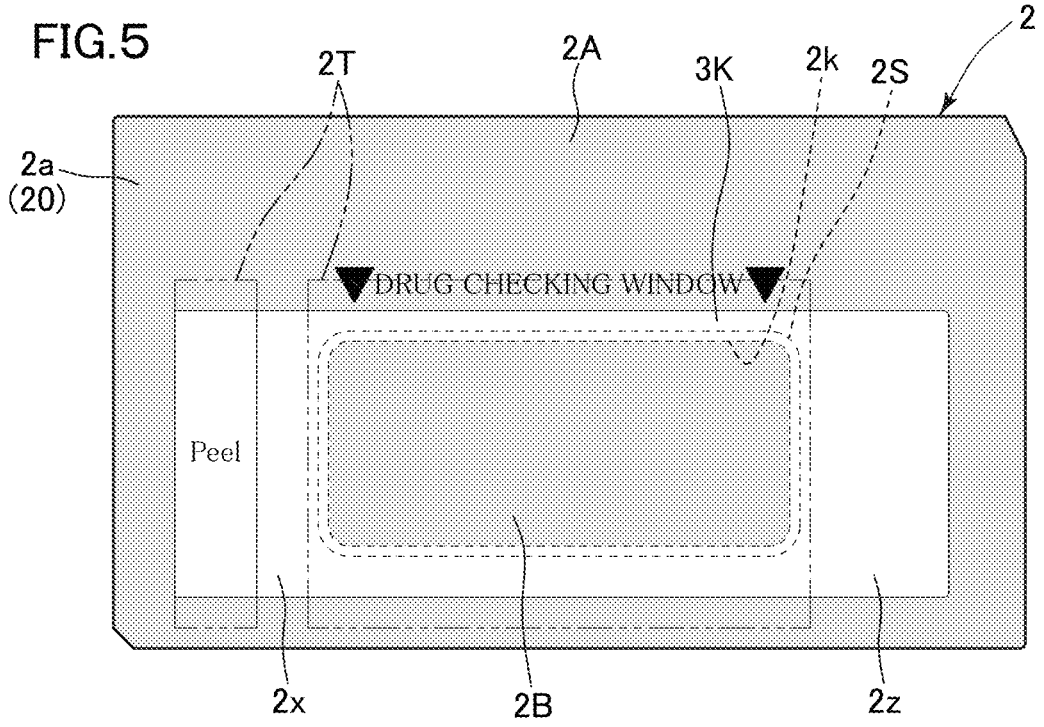
FIG. 5 shows a surface of a lower layer label as a component of the pharmaceutical container label shown in FIG. 1.
Figure 6:
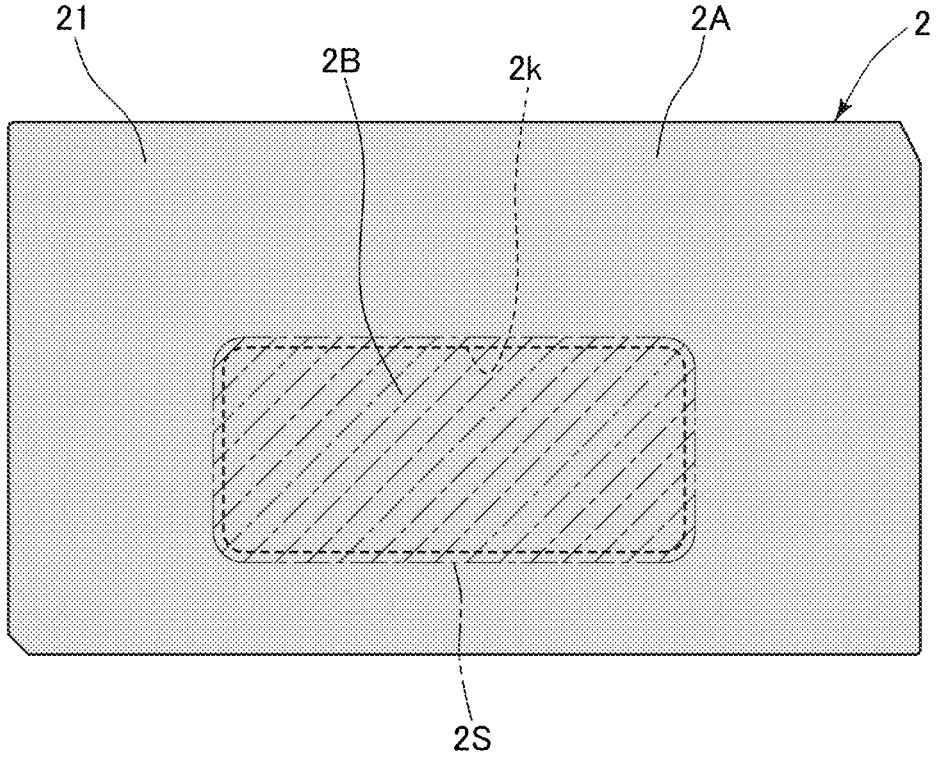
FIG. 6 shows a back surface of the lower layer label as a component of the pharmaceutical container label shown in FIG. 1.
Figure 7:
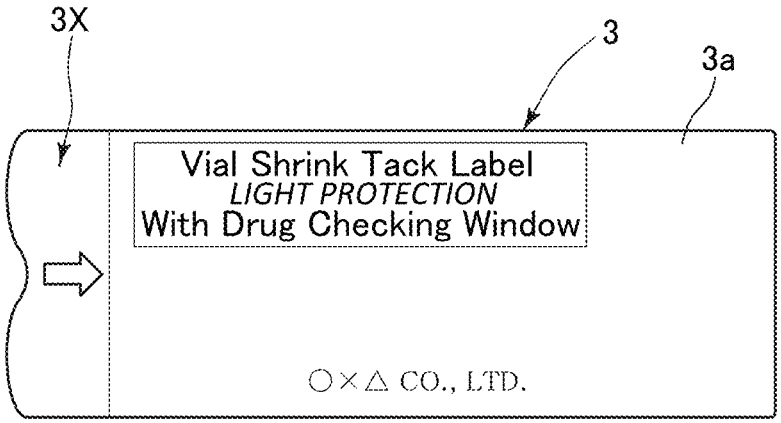
FIG. 7 shows a surface of an upper layer label as a component of the pharmaceutical container label shown in FIG. 1.
Figure 8:
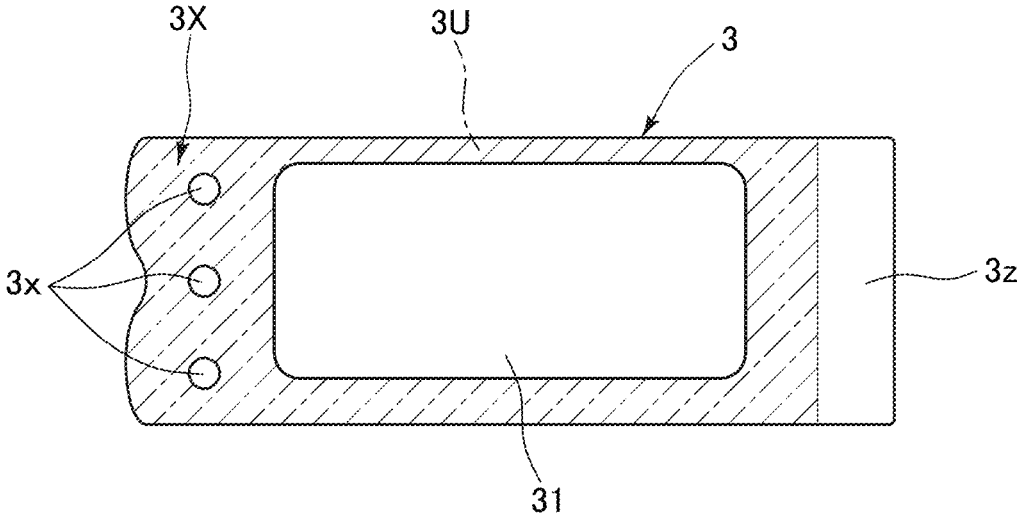
FIG. 8 shows a back surface of the upper layer label as a component of the pharmaceutical container label shown in FIG. 1.

The pharmaceutical container label 1 has a two-layer structure including a lower-layer label 2 shown in FIG. 5 and FIG. 6, and an upper-layer label 3 shown in FIG. 7 and FIG. 8.

The lower-layer label 2 is a colored and semi-transparent label having light-blocking property, and is adhered to the outer circumferential surface 12*r* (see FIG. 2) of the pharmaceutical container 100 (container body 10) so as to form a non-adhesion portion 2B (see FIG. 6). The non-adhesion portion 2B is a portion, of the lower-layer label 2, which does not adhere to the outer circumferential surface 12*r* of the pharmaceutical container 100 or is adhered thereto with an adhesive force smaller than that of a remaining portion of the lower-layer label 2. The remaining portion other than the non-adhesion portion 2B of the lower-layer label 2 serves as an adhesion portion 2A (see FIG. 6) which adheres to the outer circumferential surface 12*r* of the pharmaceutical container 100. The lower-layer label 2 is a semi-transparent brown label as a whole, and is partially colored and opaque at a printed portion and a printing region on a surface 2*a*. The adhesion portion 2A of the lower-layer label 2 also adheres to the neck portion 12N of the pharmaceutical container 100 (container body 10) and its vicinity so as to follow the shape of the neck portion 12N.

The lower-layer label 2 may be a semi-transparent label having light-blocking property, whose color is different from that of the translucent container body 10. Alternatively, the lower-layer label 2 may be an opaque label such as a metal coating formed by aluminum vapor-deposition, for example.

The upper-layer label 3 is peelably stuck to the surface 2*a* of the lower-layer label 2 so as to adhere to at least the non-adhesion portion 2B. Specifically, the upper-layer label 3 is stuck to the surface 2*a* of the lower-layer label 2 shown in FIG. 5 so as to cover the non-adhesion portion 2B and the outer peripheral side thereof as shown in FIG. 1. The upper-layer label 3 is a display label with a surface 3*a* having a solid background color such as white or blue, and necessary information printed on the background color, as shown in FIG. 7.

Figure 9:
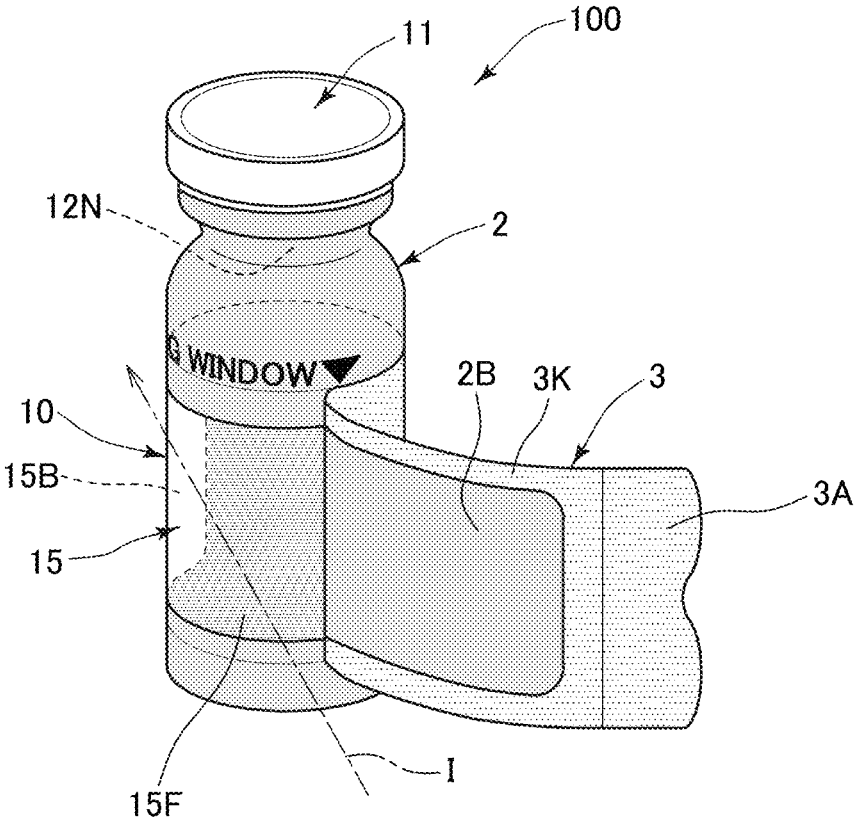
FIG. 9 is a perspective view showing a state where the upper layer label of the pharmaceutical container label stuck to the pharmaceutical container shown in FIG. 3 is peeled.

As shown in FIG. 9, the upper-layer label 3 is peelable from the lower-layer label 2. During the peeling, the upper-layer label 3 is peeled off from the lower-layer label 2 integrally with the non-adhesion portion 2B of the lower-layer label 2. The non-adhesion portion 2B of the lower-layer label 2 is not adhered to the pharmaceutical container 100 (container body 10) and is adhered to the upper-layer label 3. Therefore, when the upper-layer label 3 is peeled off, the non-adhesion portion 2B adhered thereto is peeled off integrally with the upper-layer label 3 and is separated from the lower-layer label 2 with the adhesion portion 2A being left. Thus, a region, of the pharmaceutical container 100, having been covered with the non-adhesion portion 2B of the lower-layer label 2 is exposed to the outside, and the exposed portion serves as a window 15 which allows visual checking of the contents in the pharmaceutical container 100.

As shown in FIG. 9, when the pharmaceutical container 100 is laterally viewed in a predetermined direction I from a predetermined position, the window 15 (exposed portion) is formed on both a predetermined region 15F, of an outer wall of the container, located at the near side and a predetermined region 15B, of the outer wall of the container, visually recognized at the far side from the predetermined region. Thus, the pharmaceutical container 100 is laterally viewed at a position in which the near-side and far-side windows 15 (15F, 15B) are opposed to each other in the front-back direction, whereby the state (e.g., discoloration or the like) of the contents in the pharmaceutical container can be accurately checked without being affected by the color of the lower-layer label 2.

The window 15 (exposed portion) is formed to be longer in the circumferential direction than in the vertical direction of the pharmaceutical container 100 (container body 10). In addition, the window 15 (exposed portion) is, in the circumferential direction, formed over ⅓ or more of the outer circumferential length of the pharmaceutical container 100 (container body 10), and preferably, ½ or more (an outer circumferential section of 180° or more with respect to the cylindrical trunk 12) of the outer circumferential length.

Hereinafter, the lower-layer label 2 and the upper-layer label 3 according to this embodiment will be described in detail.

Figure 10:
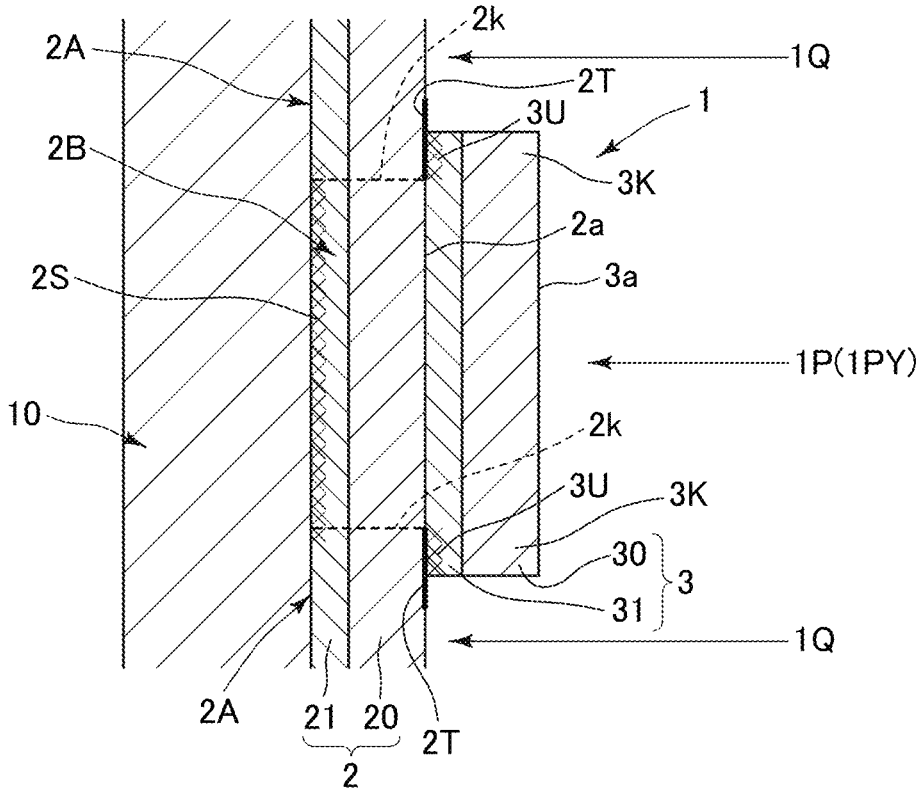
FIG. 10 is a cross-sectional view showing an X-X cross section of the pharmaceutical container label shown in FIG. 1 which is stuck to the body of the pharmaceutical container.

As shown in FIG. 10, the lower-layer label 2 integrally has: a colored (brown) and semi-transparent label base 20 made of polyethylene terephthalate and having light-blocking property; and an adhesive layer 21 made of an adhesive or a sticker, such as paste, and formed over the back surface of the label base 20. However, the adhesive layer 21 has a region 2S (adhesive-force-reduced region: a hatched region with alternate long and short dash lines shown in FIG. 6) which has been subjected to a predetermined adhesive force reduction process that reduces the adhesive force of the adhesive layer 21 to be lower than that of the remaining region, or eliminates the adhesive force. As for the adhesive force reduction process, a well-known detackifying treatment or the like may be adopted, for example. In this embodiment, a portion, of the lower-layer label 2, corresponding to the region 2S is the non-adhesion portion 2B, and a portion, of the lower-layer label 2, corresponding to the remaining region is the adhesion portion 2A. Thus, the non-adhesion portion 2B does not adhere to the outer circumferential surface 12*r* of the pharmaceutical container 100 (container body 10) or is less likely to adhere to the outer circumferential surface 12*r* of the pharmaceutical container 100 (container body 10) than the adhesion portion 2A. In addition, the lower-layer label 2 has, in a predetermined region of the surface 2*a*, a region 2T (adhesion-suppressed region: a region within a frame of an alternate long and two short dashes line shown in FIG. 5) which has been subjected to a predetermined adhesion suppressing process that makes this region difficult to be adhered to the upper-layer label 3 (adhesive layer 31). As for the adhesion suppressing process, varnish coating or the like may be adopted, for example. This facilitates peeling of the upper-layer label 3 stuck to the surface 2*a*.

As shown in FIG. 10, the upper-layer label 3 integrally has: a colored (mainly, background color such as white or blue) and opaque label base 30 made of polypropylene and having light-blocking property; and an adhesive layer 31 made of an adhesive or a sticker, such as paste, and formed over the rear surface of the label base 30. However, the adhesive layer 31 has a region 3U (adhesive-force-reduced region: a hatched region with alternate long and short dash lines shown in FIG. 8) which has been subjected to a predetermined adhesive force reduction process that reduces the adhesive force of a predetermined region to be lower than that of the remaining region. As for the adhesive force reduction process, a well-known detackifying treatment or the like may be adopted, for example. This facilitates peeling of the upper-layer label 3 from the lower-layer label 2. In addition, as shown in FIG. 7 and FIG. 8, the upper-layer label 3 has a pinch part 3X for starting peeling at an end on a first side (left side in the figures).

Figure 11:
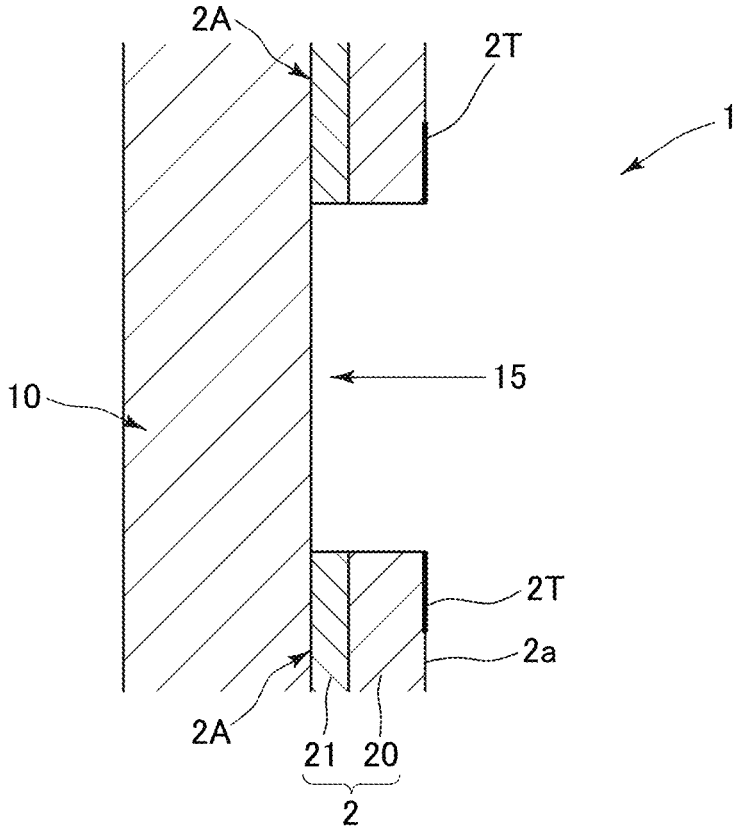
FIG. 11 is a cross-sectional view showing a state where the upper-layer label shown in FIG. 10 is peeled off.
Figure 12:
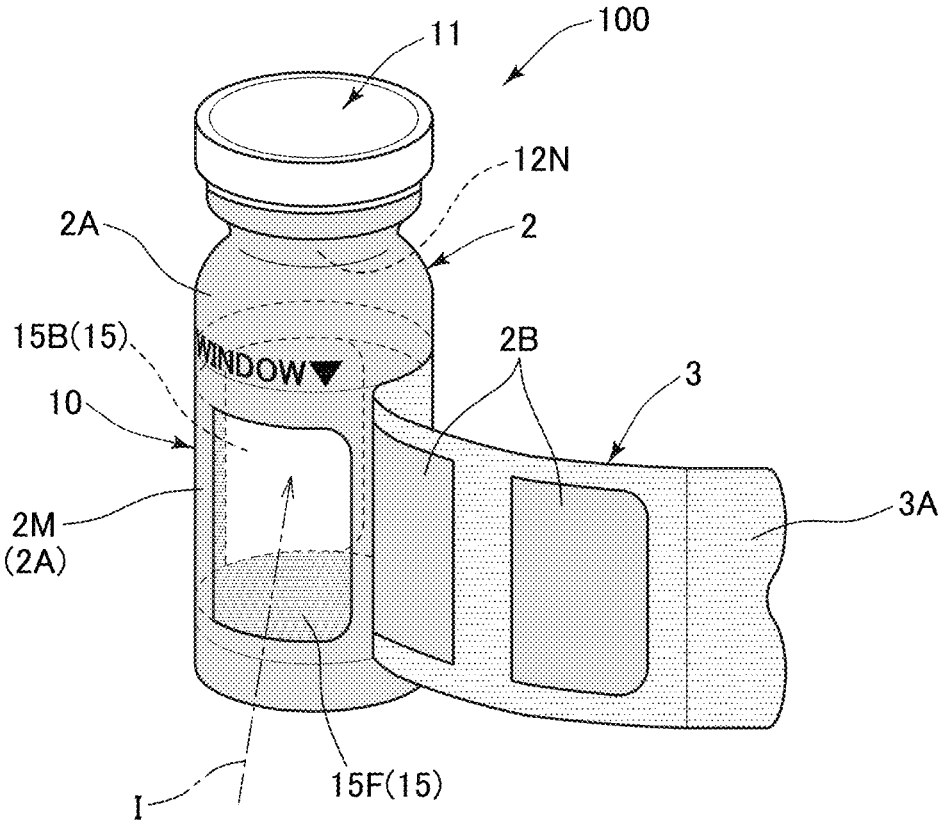
FIG. 12 is a perspective view of a pharmaceutical container, to which a pharmaceutical container label according to a second embodiment of this embodiment is stuck, in a state where an upper-layer label is peeled.

As shown in FIG. 1 and FIG. 10, the upper-layer label 3 is stuck to a part of the lower-layer label 2 in an overlapping manner, and can be peeled off from the stuck state as shown in FIG. 9 and FIG. 11. Therefore, the pharmaceutical container label 1 has: an overlapping portion 1P in which the lower-layer label 2 and the upper-layer label 3 overlap each other; and a non-overlapping portion 1Q in which these labels 2 and 3 do not overlap each other (see FIG. 1 and FIG. 10).

The overlapping portion 1P has: an integral peeling portion 1PY in which the non-adhesion portion 2B of the lower-layer label 2 is adhered to the upper-layer label 3; a pinch formation portion 1PX which is formed on the first side relative to the integral peeling portion 1PY and has the pinch part 3X for starting peeling of the upper-layer label 3; and a strong adhesion portion 1PZ which is formed on a second side, opposite to the first side, relative to the integral peeling portion 1PY and in which the upper-layer label 3 and the lower-layer label 2 are strongly adhered to each other.

The overlapping portion 1P is formed such that the pinch formation portion 1PX is formed on the first side (left side in FIG. 1) while the strong adhesion portion 1PZ is formed on the second side (right side in FIG. 1) opposite to the first side in the longitudinal direction (left-right direction in FIG. 1) of the upper-layer label 3, and the longitudinal direction of the overlapping portion 1P is the circumferential direction of the pharmaceutical container 100 (container body 10).

In the integral peeling portion 1PY, the non-adhesion portion 2B of the lower-layer label 2 is located in a center part, and adhered to the upper-layer label 3. In an outer peripheral part surrounding the center part, the upper-layer label 3 and the lower-layer label 2 are adhered to each other with an adhesive force weaker than that in the center part, so that the upper-layer label 3 can be easily peeled off from the lower-layer label 2. Specifically, the adhesive layer 31 of the upper-layer label 3 in the outer peripheral part has been subjected to the aforementioned adhesive force reduction process (indicated by 3U in FIG. 8), and the surface 2*a* of the lower-layer label 2 in the outer peripheral part has been subjected to the aforementioned adhesion suppressing process (indicated by 2T in FIG. 5). Either one of these processes may be selectively performed.

The pinch formation portion 1PX is continuous from the first side (left side in FIG. 1) of the integral peeling portion 1PY. Like the outer peripheral part of the pinch formation portion 1PX, the pinch formation portion 1PX has been subjected to both or one of the adhesive force reduction process (indicated by 3U in FIG. 8) and the adhesion suppressing process (indicated by 2T in FIG. 5), so that the upper-layer label 3 and the lower-layer label 2 are adhered to each other with a weak adhesive force. Thus, the pinch part 3X can be easily peeled and pinched with fingers when the upper-layer label 3 is peeled off.

However, the pinch formation portion 1PX has a partial strong adhesion portion which has not been subjected to one or both of the adhesive force reduction process and the adhesion suppressing process (in this embodiment, only the adhesive force reduction process has not been performed). Thus, the pinch formation portion 1PX can be adhered again after the pinch part 3X has been peeled off. In the pinch formation portion 1PX, a plurality of partial strong adhesion portions 3*x* (see FIG. 8) not having been subjected to the adhesive force reduction process are present in the upper-layer label 3, and are somewhat strongly adhered to the lower-layer label 2. In addition, the pinch formation portion 1PX has, on the integral peeling portion 1PY side, a partial strong adhesion portion 2*x* (see FIG. 5) not having been subjected to the adhesion suppressing process in the lower-layer label 2, and the partial strong adhesion portion 2*x* is somewhat strongly adhered to the upper-layer label 3.

The strong adhesion portion 1PZ is continuous from the second side (right side in FIG. 1) of the integral peeling portion 1PY, and has not been subjected to both the adhesive force reduction process and the adhesion suppressing process. Therefore, in the strong adhesion portion 1PZ, the upper-layer label 3 (indicated by 3*z* in FIG. 8) and the lower-layer label 2 (indicated by 2*z* in FIG. 5) are adhered to each other with the original adhesive force of the adhesive layer 31. Thus, the strong adhesion portion 1PZ is not peeled off even when the upper-layer label 3 is peeled off from the pinch part 3X side, keeps the upper-layer label 3 and the lower-layer label 2 to be integral, and enables the pinch part 3X to be adhered again at the same position in the lower-layer label 2. This re-adhesion enables the window 15 (exposed portion: see FIG. 9) for visual checking, which is formed by the peeling, to be covered with the non-adhesion portion 2B of the lower-layer label 2 and returned to the light-blocking state.

As shown in FIG. 5, FIG. 6, and FIG. 10, in the integral peeling portion 1PY, a cut line 2*k* (perforated line) is formed so as to surround the region to be the window 15 (exposed portion) for visual checking, inside the outer periphery of the non-adhesion portion 2B of the lower-layer label 2. Thus, when the upper-layer label 3 is peeled off from the lower-layer label 2, the non-adhesion portion 2B is separated along the cut line 2*k*, which enables the separation from the lower-layer label 2 to smoothly progress. Meanwhile, the upper-layer label 3 is stuck to the surface 2*a* of the lower-layer label 2 so as to include the cut line 2*k*. That is, the upper-layer label 3 has a cut line covering portion 3K which is stuck to the lower-layer label 2 so as to cover the cut line 2*k*. Since the cut line 2*k* is formed in an annular shape, an annular cut line covering portion 3K is formed to cover the cut line 2*k*. The cut line covering portion 3K prevents light from entering through the cut line 2*k*. The cut line covering portion 3K covers the external side of the outer periphery of the non-adhesion portion 2B when the upper-layer label 3, which has been peeled off, is adhered again. Therefore, even if the non-adhesion portion 2B of the lower-layer label 2 is shifted from the original position during the re-adhesion, it is possible to prevent light from entering onto the window (exposed portion) 15 for visual checking through a gap caused by the shifting.

Although the first embodiment of this invention has been described above, the first embodiment is merely illustrative, and this invention is not limited thereto. For example, various modifications, such as omissions of some components and additions of other components in the first embodiment, may be made based on the knowledge of a person skilled in the art.

Hereinafter, other embodiments different from the above first embodiment, and modifications, will be described. Note that parts having the same functions as those in the first embodiment are denoted by the same reference characters, and the detailed description thereof is omitted. The first embodiment and the following embodiments may be combined to be implemented as appropriate as long as no technical contradiction arises.

The second embodiment of this invention will be described with reference to FIG. 12 to FIG. 15.

The pharmaceutical container label 1 according to the second embodiment is different from the first embodiment in that the window 15, which is formed by peeling the upper-layer label 3 from the lower-layer label 2, is not continuous in the circumferential direction of the pharmaceutical container 100 but is divided into two windows (exposed portions) 15F and 15B.

Figure 13:
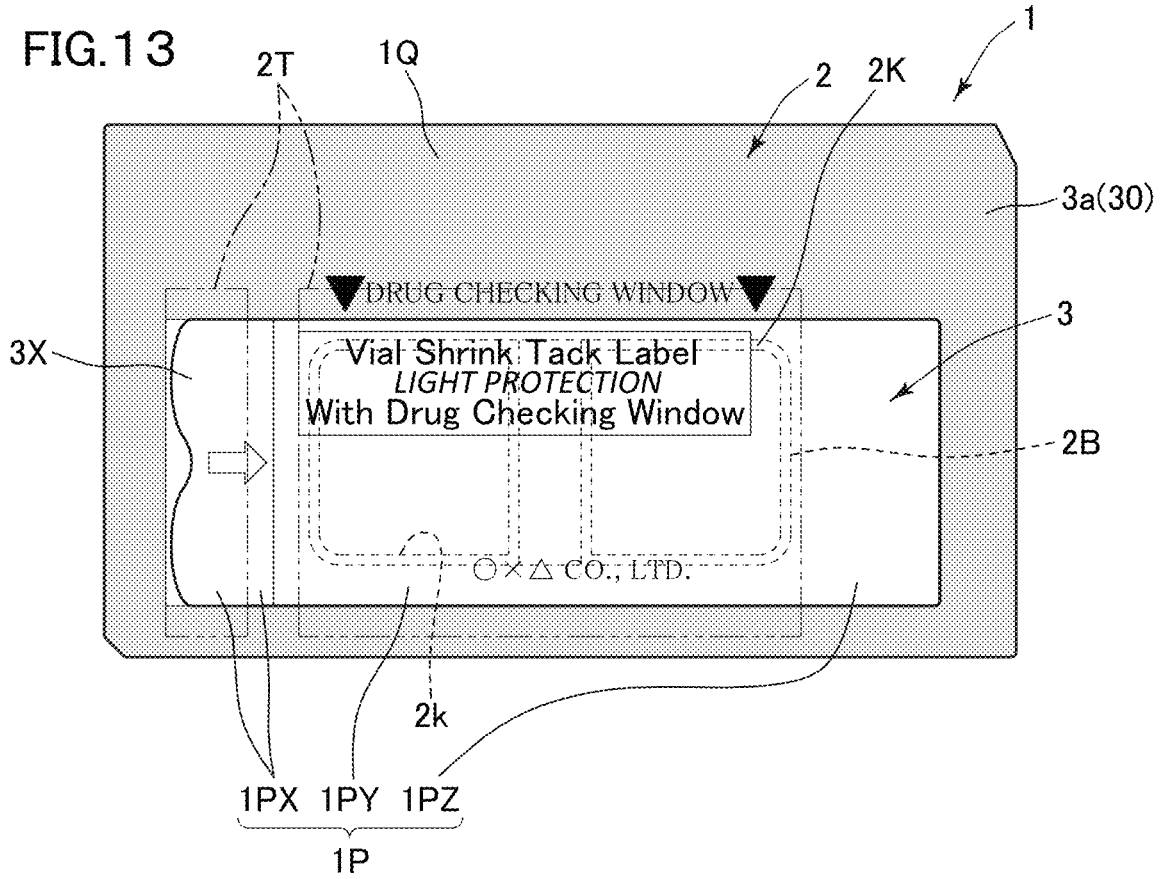
FIG. 13 is a plan view of the pharmaceutical container label shown in FIG. 12.
Figure 14:
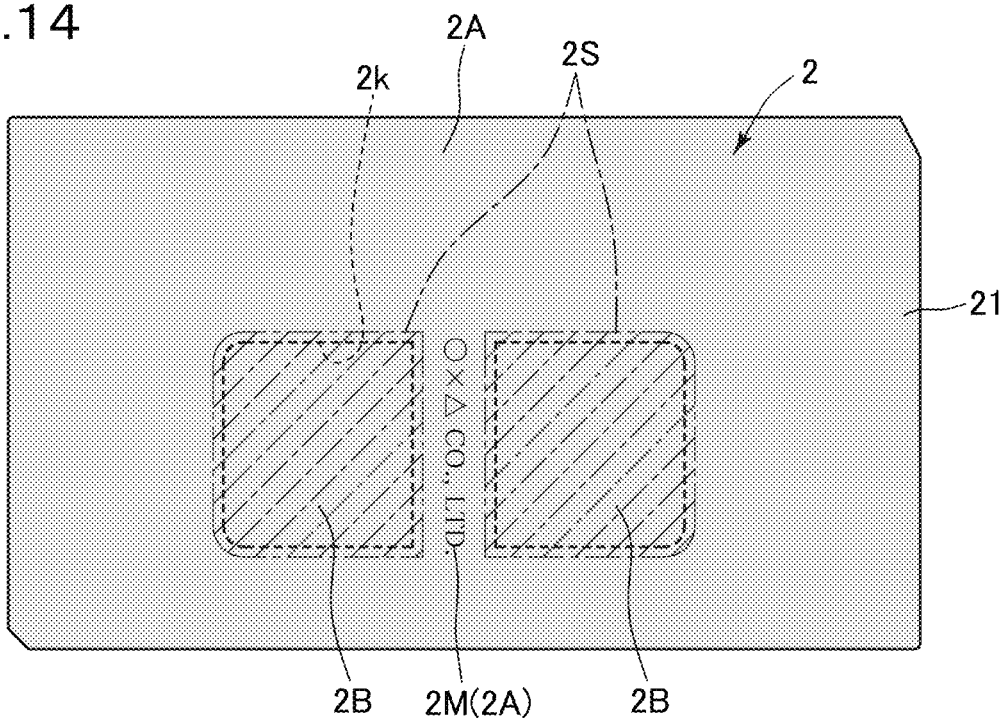
FIG. 14 shows a back surface of a lower-layer label as a component of the pharmaceutical container label shown in FIG. 13.
Figure 15:
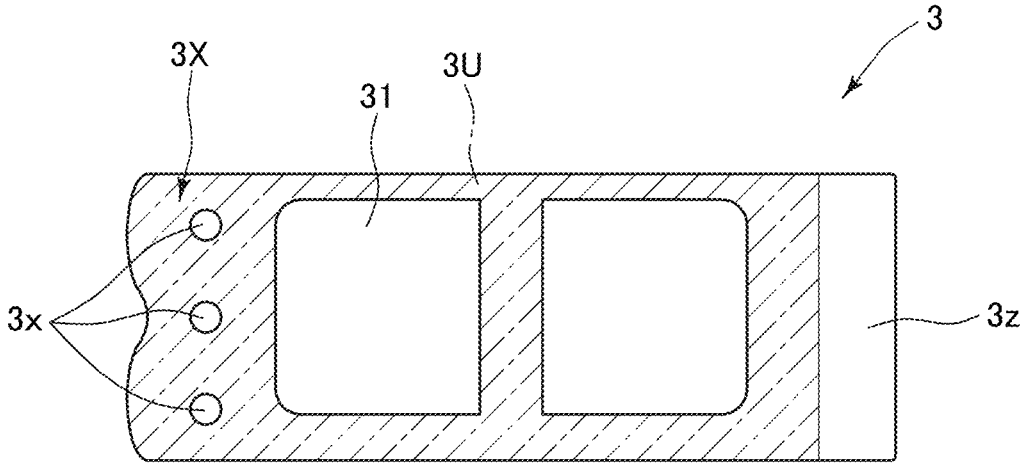
FIG. 15 shows aback surface of an upper-layer label as a component of the pharmaceutical container label shown in FIG. 13.

A division part 2M is a part of the adhesion portion 2A in the lower-layer label 2. As shown in FIG. 13, the lower-layer label 2 has non-adhesion portions 2B, 2B which form the aforementioned near-side and far-side windows 15F, 15B (15) at both sides of the adhesion portion 2A. The surface of the division part 2M has not been subjected to a predetermined peeling allowance process (the adhesive force reduction process and the adhesion suppressing process of the first embodiment) that allows peeling of the upper-layer label 3. Therefore, when the upper-layer label 3 is peeled off, the division part 2M is not peeled off integrally with the upper-layer label 3 but remains stuck to the pharmaceutical container 100 (container body 10). Therefore, the division part 2M can be used as a display part that is visually recognizable even after the peeling. Specifically, for example, a display printed as shown in FIG. 13 can be made on the division part 2M. Alternatively, a display regarding checking of the state of the contents in the pharmaceutical container 100, e.g., a display describing what state is an abnormal state, may be made. The upper-layer label 3 is different from that of the first embodiment in that, as shown in FIG. 15, a portion, of the lower-layer label 2, corresponding to the division part 2M is a region 3U having been subjected to the adhesive force reduction process.

A third embodiment of this invention will be described with reference to FIG. 16 to FIG. 18.

Figure 16:
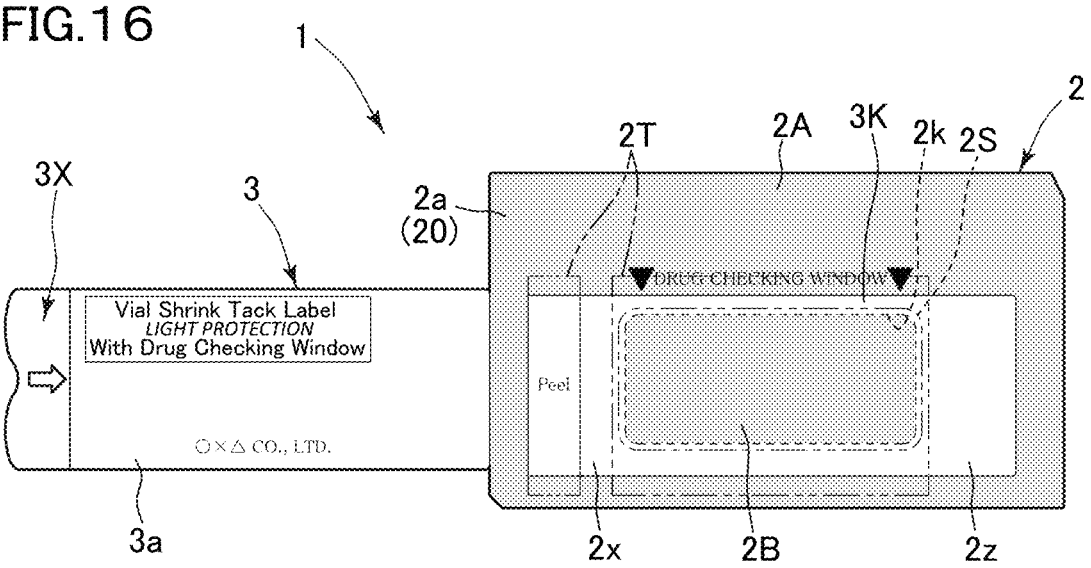
FIG. 16 is a plan view showing a pharmaceutical container label according to a third embodiment of this invention.
Figure 17:
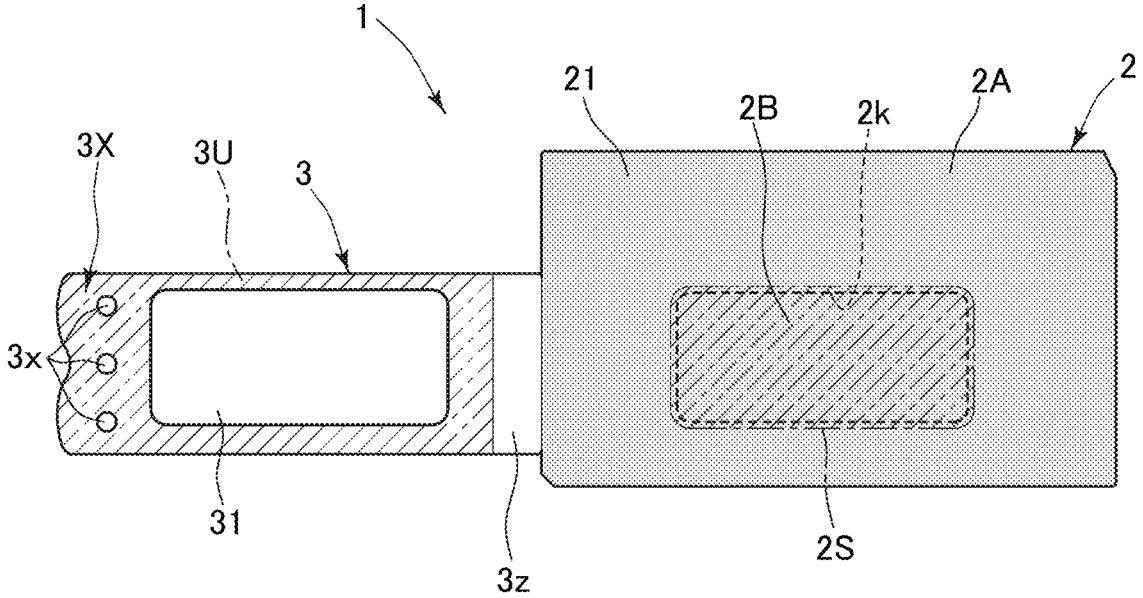
FIG. 17 shows a back surface of the pharmaceutical container label shown in FIG. 16.
Figure 18:
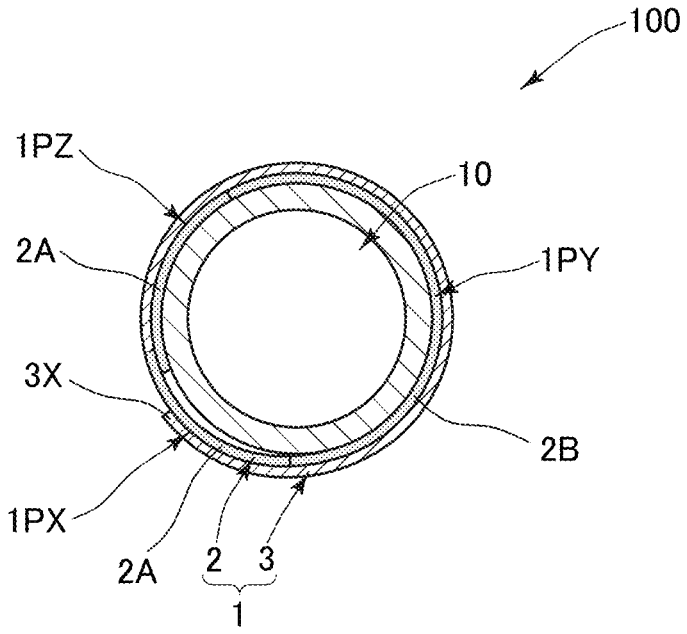
FIG. 18 is a horizontal cross-sectional view, at a center portion in the vertical direction, of a pharmaceutical container to which the pharmaceutical container label shown in FIG. 16 is stuck.
Figure 19:
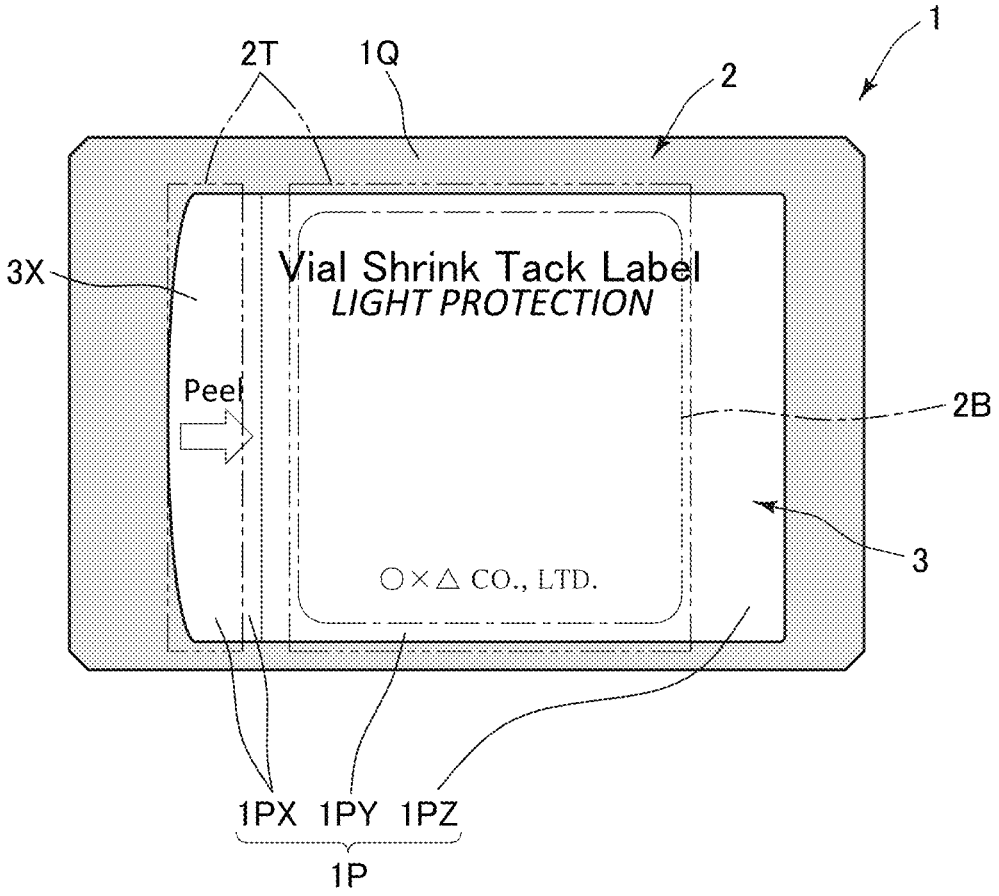
FIG. 19 is a plan view of a pharmaceutical container label according to a fourth embodiment of this embodiment.
Figure 20:
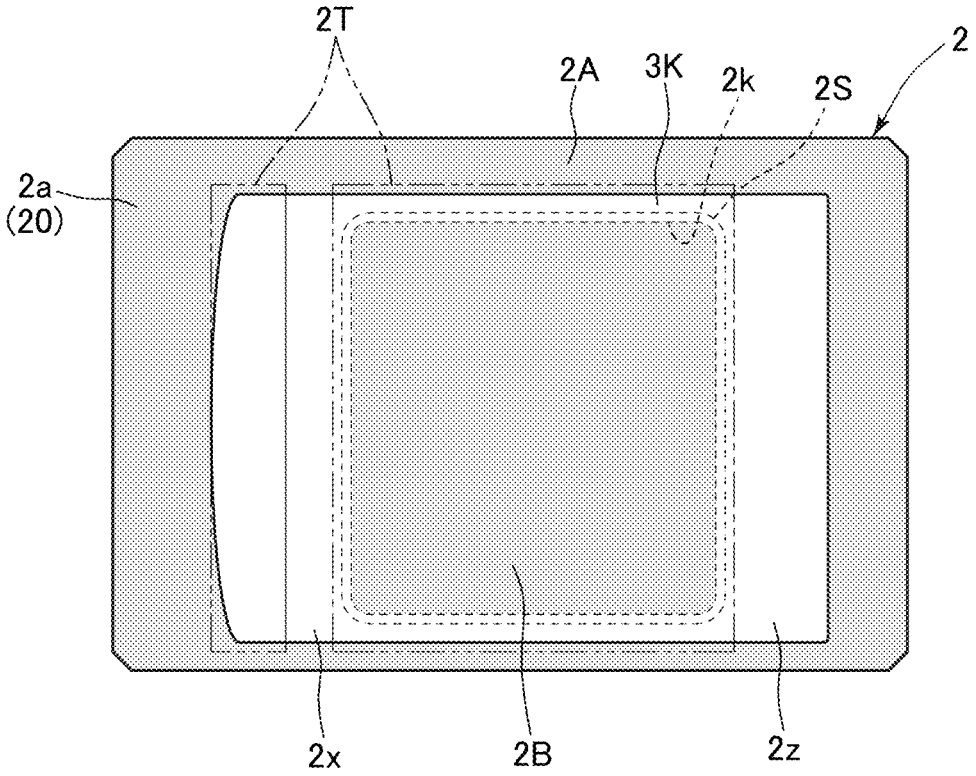
FIG. 20 shows a surface of a lower-layer label as a component of the pharmaceutical container label shown in FIG. 19.
Figure 21:
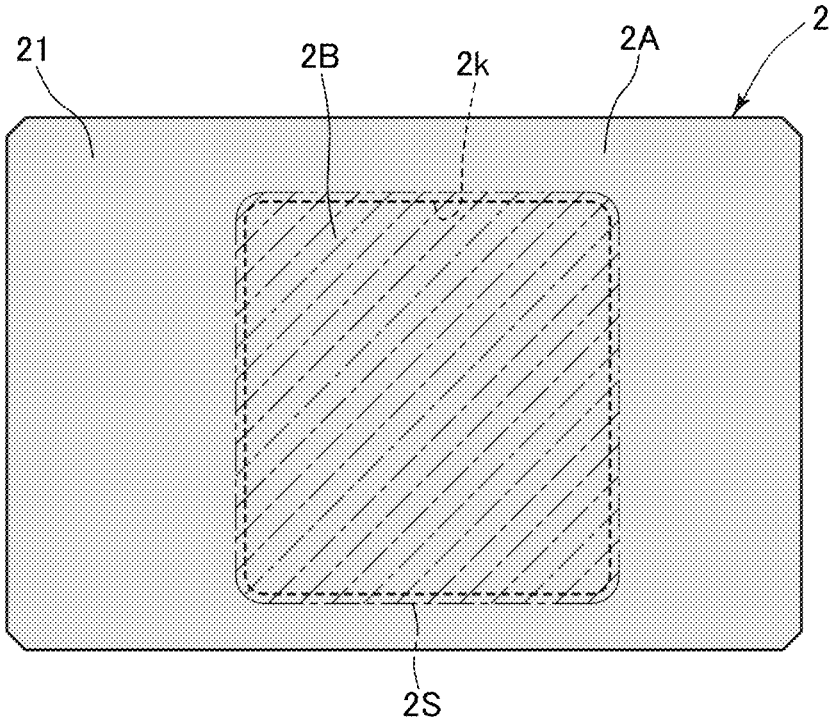
FIG. 21 shows a back surface of the lower-layer label as a component of the pharmaceutical container label shown in FIG. 19.
Figure 22:
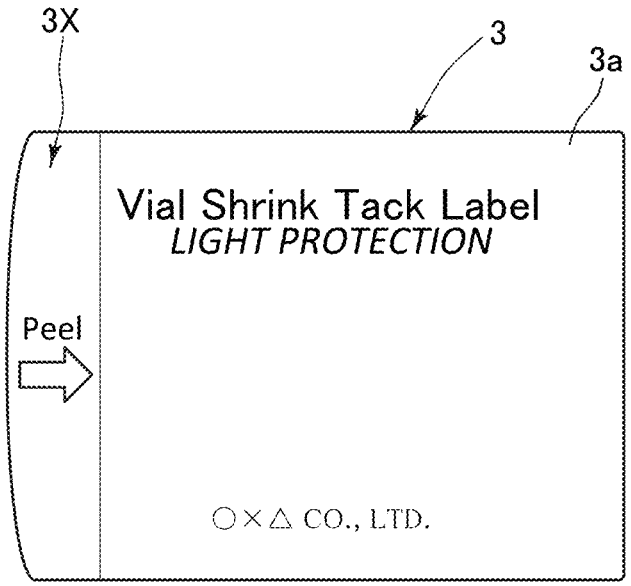
FIG. 22 shows a surface of an upper-layer label as a component of the pharmaceutical container label shown in FIG. 19.
Figure 23:
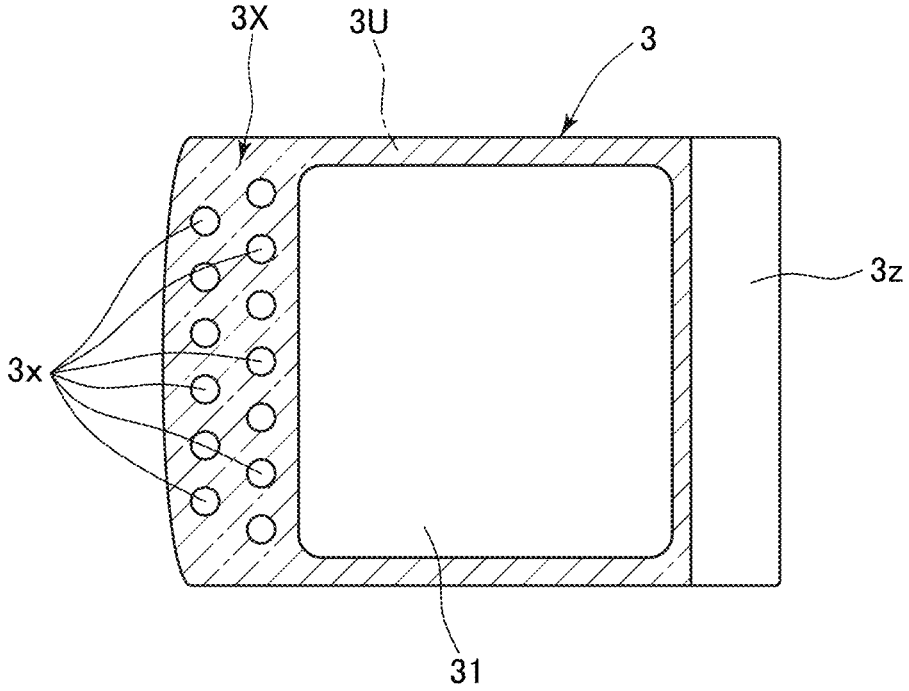
FIG. 23 shows a back surface of the upper-layer label as a component of the pharmaceutical container label shown in FIG. 19.

In the pharmaceutical container label 1 of the third embodiment, as shown in FIG. 16 and FIG. 17, the upper-layer label 3 and the lower-layer label 2 are formed as one label continuous in the peeling direction of the upper-layer label 3. The pharmaceutical container label 1 having the continuous upper and lower layers is, as shown in FIG. 18, stuck so as to surround the outer circumferential surface 12*r* of the pharmaceutical container 100 (container body 10) from an end of the lower-layer label 2 located on the side opposite to the pinch part 3X of the upper-layer label 3. After the lower-layer label 2 has been stuck to the outer circumferential surface 12*r*, the remaining upper-layer label 3 is stuck to the lower-layer label 2 in an overlapping manner. Thus, since the pharmaceutical container label 1 of the third embodiment can be formed as a single label integrally having the upper-layer label 3 and the lower-layer label 2, the manufacturing process can be simplified and the manufacturing cost can be reduced. In the pharmaceutical container label 1 of the third embodiment, since the upper-layer label 3 and the lower-layer label 2 are integrally connected to each other, the strong adhesion portion 1PZ (the region 3*z* of the upper-layer label 3 and the region 2*z* of the lower-layer label 2) of the first embodiment can be dispensed with. Also, the upper-layer label 3 can be shortened.

The second embodiment and the third embodiment are identical to the first embodiment in the following points. That is, the upper-layer label 3 is stuck on the lower-layer label 2, and these labels are peelable through the predetermined peeling allowance process. This peeling allows the non-adhesion portion 2B of the lower-layer label 2 to be peeled off integrally with the upper-layer label 3, thereby forming the window 15 on the pharmaceutical container 100. When the pharmaceutical container 100 after the peeling is laterally viewed in the predetermined direction I from the predetermined position, the window 15 (exposed portion) is present in both the predetermined region, of the outer wall of the container 100, located at the near side and the predetermined region, of the outer wall of the container 100, visually recognized at the far side from the near-side predetermined region. The cut line 2*k* of the lower-layer label 2 is covered with the cut line covering portion 3K of the upper-layer label 3.

A fourth embodiment of this invention will be described with reference to FIG. 19 to FIG. 25.

Figure 24:
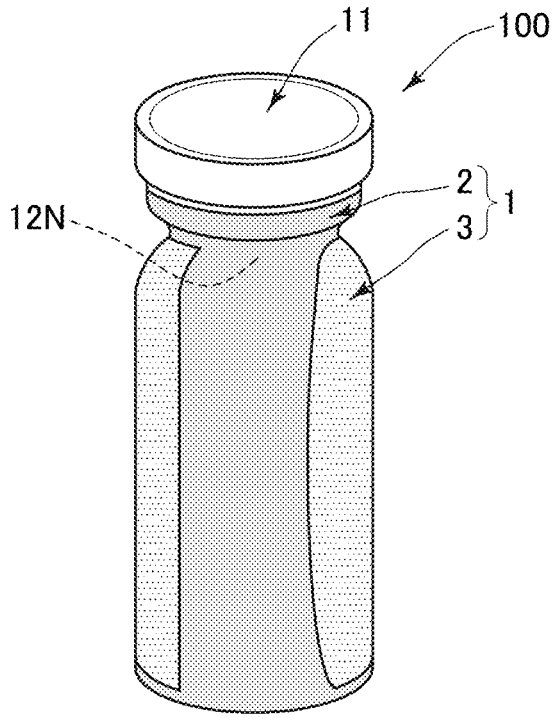
FIG. 24 is a perspective view of a pharmaceutical container to which the pharmaceutical container label shown in FIG. 19 is stuck.
Figure 25:
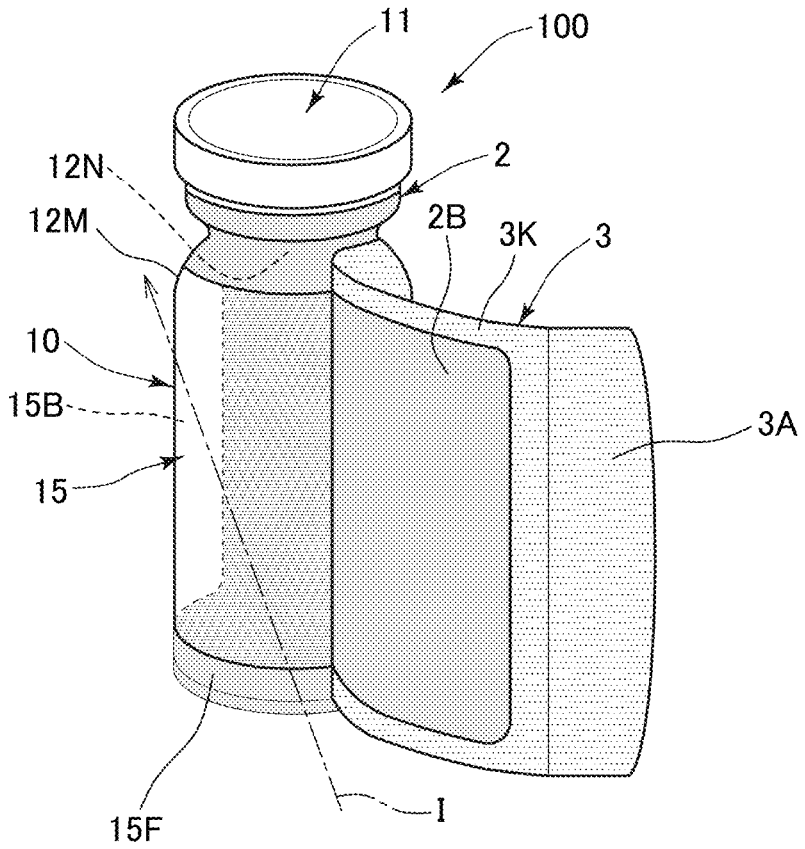
FIG. 25 is a perspective view of the pharmaceutical container shown in FIG. 24 in a state where the upper-layer label of the pharmaceutical container label stuck thereto is peeled.

As shown in FIG. 19 to FIG. 23, in the pharmaceutical container label 1 of the fourth embodiment, the width of the upper-layer label 3 in the vertical direction is wider than the widths in the aforementioned embodiments. Thus, more necessary information can be displayed on the label. As shown in FIG. 24 and FIG. 25, the pharmaceutical container label 1 is adhered to the outer circumference of the pharmaceutical container 100 (container body 10), and also adhered to the neck portion 12N and its vicinity so as to follow the shape of the neck portion 12N. When the window 15 is formed on the pharmaceutical container 100 as shown in FIG. 25, the window 15 is located beneath the neck portion 12N of the trunk 12, and is also present at a shoulder part 12M which slopes so as to face upward. Thus, the contents in the pharmaceutical container 100 can be visually checked from above.

DESCRIPTION OF THE REFERENCE CHARACTERS

1 pharmaceutical container label
10 container body
15 window (exposed portion)
100 pharmaceutical container
2 lower-layer label
2A adhesion portion
2B non-adhesion portion
20 label base of lower-layer label
21 adhesive layer of lower-layer label
3 upper-layer label
30 label base of upper-layer label
31 adhesive layer of upper-layer label

The invention claimed is:

1. A pharmaceutical container label to be stuck to an outer circumferential surface of a pharmaceutical container having translucency, the label comprising:

a lower-layer label, having light-blocking property, to be adhered to the outer circumferential surface of the pharmaceutical container by a lower-layer label adhesive layer formed on a back surface facing the outer circumferential surface of the pharmaceutical container; and an upper-layer label which is adhered to a surface of the lower-layer label by an upper-layer label adhesive layer formed on a back surface facing the surface of the lower-layer label, wherein in addition to the lower-layer label adhesive layer, the back surface of the lower-layer label has an adhesive-force-reduced region which has been subjected to a predetermined adhesive force reduction process that reduces the adhesive force of the lower-layer label adhesive layer, or eliminates the adhesive force of the lower-layer label adhesive layer, the lower-layer label has a cut line which surrounds an outer periphery of the adhesive-force-reduced region, the upper-layer label has a band shape in which a central portion and two opposing end portions are integrally formed, and the central portion is formed corresponding to a portion of the lower-layer label surrounded by the cut line, and the upper-layer label is formed in a size capable of covering the cut line so that the cut line is not exposed to the outside, the upper-layer label adhesive layer is formed on at least the back surface of the one end portion and the back surface of the central portion, and in the upper-layer label, the central portion is integrated with the portion of the lower-layer label surrounded by the cut line in a state where the one end portion is adhered to the surface of the lower-layer label and is not peeled off, and the central portion is configured so that the portion of the lower-layer label surrounded by the cut line can be separated from remaining portions of the lower-layer label along the cut line.

2. The pharmaceutical container label according to claim 1, wherein in addition to the one end portion and the central portion on the back surface of the upper-layer label on which the upper-layer label adhesive layer is formed, the back surface of the upper-layer label has an adhesive-force-reduced region which has been subjected to a predetermined adhesive force reduction process that reduces the adhesive force of the upper-layer label adhesive layer, or eliminates the adhesive force of the upper-layer label adhesive layer in an outer peripheral portion surrounding the central portion.

3. The pharmaceutical container label according to claim 2, wherein the back surface of the other end portion of the upper-layer label is subjected to the adhesive force reduction process so that the other end portion of the upper-layer label functions as a pinch part for starting peeling from the lower-layer label, and an adhesion portion that has not been subjected to the adhesive force reduction process is partially formed on the back surface of the other end portion of the upper-layer label, and the other end portion of the upper-layer label after peeling is configured to be reattachable to the surface of the lower-layer label by the adhesion portion.

4. A method of using the pharmaceutical container label according to claim 1, wherein when the upper-layer label is peeled off while the lower-layer label is adhered to the outer circumferential surface of the pharmaceutical container, a region, of the pharmaceutical container, covered with the portion of the lower-layer label surrounded by the cut line is exposed to the outside, and the exposed portion allows visual checking of contents.

5. The method of using the pharmaceutical container label according to claim 4, wherein when the pharmaceutical container is laterally viewed from a predetermined position, the exposed portion is formed in both a predetermined region, of an outer wall of the container, which is located at a near side, and a predetermined region, of the outer wall of the container, which is visually recognized at a far side relative to the near-side region.

* * * * *